US006261301B1

(12) United States Patent
Knesch et al.

(10) Patent No.: US 6,261,301 B1
(45) Date of Patent: Jul. 17, 2001

(54) EPILATION DEVICE AND METHOD

(75) Inventors: Holger Knesch, Ludwigsburg; Klaus Kötterheinrich, Mühlheim, both of (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 09/424,585

(22) PCT Filed: Apr. 8, 1998

(86) PCT No.: PCT/EP98/02024

§ 371 Date: Nov. 24, 1999

§ 102(e) Date: Nov. 24, 1999

(87) PCT Pub. No.: WO98/55000

PCT Pub. Date: Dec. 10, 1998

(30) Foreign Application Priority Data

Jun. 6, 1997 (DE) ..... 197 23 910

(51) Int. Cl.[7] ..... A61B 17/50
(52) U.S. Cl. ..... 606/131; 606/133
(58) Field of Search ..... 606/43, 131, 133, 606/1, 36; 219/233, 223, 384; 128/908; 452/84–85, 100, 101, 102, 104

(56) References Cited

U.S. PATENT DOCUMENTS

| | | | | |
|---|---|---|---|---|
| 3,614,382 | * | 10/1971 | Politzer | 219/223 |
| 3,994,300 | | 11/1976 | Siddons . | |
| 4,741,347 | | 5/1988 | Robert et al. . | |
| 4,846,179 | * | 7/1989 | O'Connor | 607/72 |
| 5,810,843 | * | 9/1998 | Iwasaki et al. | 606/133 |
| 5,916,222 | * | 6/1999 | Iwasaki et al. | 606/131 |
| 6,004,331 | * | 12/1999 | Takeuchi et al. | 606/133 |
| 6,083,233 | * | 7/2000 | Kreutz et al. | 606/133 |

FOREIGN PATENT DOCUMENTS

| | | | | |
|---|---|---|---|---|
| 36 28 216 A1 | | 5/1987 | (DE) . | |
| 44 08 809 C1 | | 6/1995 | (DE) . | |
| 4408809 | * | 6/1995 | (DE) | 606/131 |
| 195 21 585 A1 | | 12/1996 | (DE) . | |
| 2 293 767 | | 4/1996 | (GB) . | |
| 97/00032 | | 1/1997 | (WO) . | |

* cited by examiner

*Primary Examiner*—Pedro Philogene
(74) *Attorney, Agent, or Firm*—Fish & Richardson P.C.

(57) ABSTRACT

The invention is directed to an epilation appliance and a method for using the appliance, in particular for epilation of the human skin, with a hand-holdable housing which accommodates a motor for driving a clamping device (14), particularly a rotary clamping device, which is provided in the appliance and equipped with clamping elements (16) to grip and pluck the hairs, and with a component for reducing the sense of pain during the extraction of hairs, the component including at least one electrode. With the component an electric spark (76) is producible on the skin prior to the extraction of the hairs, the spark (76) provoking an additional pain corresponding in its pain characteristic to the pain of epilation, but preferably having a lower pain intensity.

23 Claims, 3 Drawing Sheets

EPILATION DEVICE AND METHOD

BACKGROUND OF THE INVENTION

This invention relates to an epilation appliance and to a method for using said appliance, in particular for epilation of the human skin. The appliance is comprised essentially of a hand-holdable housing which accommodates a motor for driving a clamping device, particularly a rotary clamping device, which is provided in the appliance and equipped with clamping elements to grip and pluck the hairs, and with a means for reducing the sense of pain during the extraction of hairs, said means comprising at least one electrode.

An appliance of this type is known from DE 44 08 809 C1, the disclosure content of which shall be deemed to be incorporated in the present application by express reference. Said appliance has in particular two electrodes which, in order to extract the hairs, can be brought into contact with the skin at the same time as the clamping device. A generator of stimulating current, in particular a pulse generator or the like, is assigned to the appliance, and the generator's outputs are connected to the electrodes.

A general problem facing epilation appliances is to increase their effectiveness during epilation on the one hand and to reduce the user's sense of pain during the removal of the hairs on the other hand. To this end, the above mentioned appliance uses nerve stimulation produced by the action of a stimulating current, particularly pulses of current, on the skin in order, by irritation or stimulation of the underlying nerve structures, to reduce or even eliminate the pain while the appliance is being used for epilation. During use of the above described appliance the electrodes and the clamping device are jointly in contact with the skin, the treatment of the skin involving the application of pulses of current emitted via the electrodes by means of a pulse generator or the like. These pulses of current ensure that the body's own pain inhibiting systems existing in the human organism are activated electrically, thus masking or blocking the transmission of those pulses of pain produced by extraction of the hairs. The intensity of the stimulating current can be set individually so that in the area between the electrodes the user feels a slight itching, tingling or the like on the skin but without the triggering of any muscle contractions.

SUMMARY OF THE INVENTION

It is an object of the present invention to further develop an epilation appliance and a method, particularly for epilation of the human skin, to the extent that the sense of pain during use of the appliance is further reduced by further masking of the pain of epilation, for example, and that the point of epilation on the skin can always be viewed by the user and is not obstructed by the appliance itself. Furthermore, it is desirable for the intensity of the superposed or masking pain to be uniform and independent of the angle of engagement of the appliance relative to the skin surface.

According to the present invention this object is accomplished in that with an epilation appliance of the type referred to in the foregoing it is possible to produce an electric spark on the skin prior to the extraction of the hairs using the means for reducing the sense of pain. With an epilator of this type, advantageously nerve stimulation is positively influenced by the spark discharge to such a degree as to achieve a notable reduction of the sense of pain during epilation, as practical tests have shown. The epilation process is experienced by the user as more agreeable than with an appliance operating without the proposed spark discharge. Furthermore, the current point of epilation on the skin can be viewed at any time by the user and the intensity of masking of the pain of epilation is individually adjustable by the user so that an agreeable intensity can be set for the individual's sense of pain. What is more, the pain masking intensity does not depend on the angle at which the appliance is held against the skin but is guaranteed advantageously at every moment of the epilation because the spark discharge depends on the distance required in each case between the electrode and the skin surface requiring epilation.

In an advantageous embodiment of the present invention the means for reducing the sense of pain is equipped with a voltage source, in particular for electric voltages greater than 0.8 KV, and at least one electrode connectable to said voltage source, said electrode being at least temporarily a distance away from the skin, thus enabling the spark to be produced in the air gap between the skin and the electrode.

According to a particularly advantageous further aspect of the present invention the epilation appliance is equipped with a means comprising at least two electrodes and a high-voltage source, in particular for voltages of between 0.8 and 3.0 KV. In this arrangement the at least two electrodes are connectable to the high-voltage source, and at least a first electrode is movable at least temporarily into contact with the skin and at least a second electrode is at least temporarily a distance away from the skin, thus enabling the spark to be produced in the air gap between the skin requiring epilation and the first and/or second electrode. Since the electrodes are connectable to a high-voltage source, spark emission is advantageously performed independently of skin resistance and hence without touching the skin. A preferred voltage range lies between 1.0 and 2.5 KV. Furthermore, since the at least one first electrode can be moved into contact with the skin at least temporarily and the at least one second electrode is a distance away from the skin at least temporarily, several variation options result advantageously for the design of the first and second electrodes:

Thus it is possible, for example, for the at least one first electrode to be designed so that it is continuously in contact with the skin requiring epilation and for the at least one second electrode to be moved discontinuously in contact with the skin in such a way, for example, that the second electrode is movable towards and away from the skin. Spark discharge then takes place in the air gap between the second electrode and the skin.

Advantageously, in a second embodiment both the first and the second electrode are movably fitted to the epilator so that the two electrodes are moved either simultaneously or with a time lag towards and away from the skin. The time lag is such that, for example, the first electrode is in contact with the surface of the skin while at the same time the second electrode is a distance away from the skin so that a spark discharge takes place in the air gap between the second electrode and the skin.

A third alternative embodiment is comprised, for example, of two electrodes in a quasi fixed arrangement on the epilation appliance. In this embodiment the at least one first electrode is in quasi continuous contact with the skin and the at least one second electrode is continuously arranged a predetermined distance from the skin; in this arrangement, however, the at least one second electrode is triggered electronically so that at the right moment prior to epilation of the skin an electric spark can be produced between the second electrode and the skin.

According to an advantageous aspect of the present invention at least one electrode is connected to the clamping device and constructed in particular as a clamping element, brush, contact ring, contact disk or the like. Such an electrode can be used advantageously to produce a discontinuous contact with the skin because the electrode approaches and recedes from the skin when the clamping device is rotated. One electrode in continuous contact with the skin is constructed advantageously as a contact shoe, contact bridge, sliding contact, suction contact, contact pad or contact plate or the like and arranged on the outside of the appliance housing.

Advantageously, a separate contact pin for connecting to the high-voltage source and extending essentially parallel to the axis of rotation of the clamping device constructed as a rotary cylinder is allocated to the at least one electrode, in particular a clamping element. A component required for the mechanical actuation of the epilator, namely the contact pin for driving the clamping elements, can thus also be used as electrical component for electrically connecting the clamping elements to the voltage source.

In a particular further development of the epilation appliance, two or more electrodes, in particular clamping elements, are arranged side by side on the rotary cylinder and in a row parallel to the axis of rotation. One or several rows of clamping elements constructed as electrodes can thus be provided advantageously on a cylinder, and all the clamping elements of one row can be in contact simultaneously with the skin requiring epilation. Alternatively, the clamping elements of one row are arranged at an angular offset to the clamping elements of a neighboring row so that at a certain moment only two clamping elements of one row come into contact with the skin and the clamping elements of the following row reach a contact point on the skin that is offset relative to the preceding row.

In a particular embodiment of the present invention, the contact pin is adapted to make contact at the one end with an electrode, in particular a clamping element, and/or at the other end with a sliding ring or the like, said sliding ring or the like being connectable in turn to the high-voltage source. This results advantageously in a simple, low-cost implementation of the electrical connection between a high-voltage source, provided in particular inside the appliance housing, and the clamping elements, constructed as electrodes, without the use of any additional components that are not already required for the mechanical actuation of the clamping elements.

In a further embodiment of the present invention, the rotary cylinder has an electrically conductive shaft that is carried in bushings in the appliance housing, and/or said at least one electrode, particularly a clamping element, is joinable to the shaft by an electrically conductive connection on the one hand and/or at least one bushing is joinable to the high-voltage source by an electrically conductive connection on the other hand. Economy of construction is achieved advantageously by using the mechanically essential parts as electrically conductive parts.

In a further particular embodiment of the present invention, provision is made for at least one group of electrodes, particularly clamping elements, of equal electric potential, but preferably provision is made for at least two groups of clamping elements of unequal electric potential; in the latter case provision is made between the two groups of electrodes for an electrically neutral area, particularly an insulator, so that no arcing occurs between the two groups of electrodes of unequal electric potential. The thickness of the insulator, that is, the distance between the two groups of electrodes is selected depending on the maximum producible voltage value. It is thus possible by simple means for the two groups of electrodes of unequal electric potential to be arranged inside the clamping device, in particular the rotary cylinder, required for epilation without having to provide additional components on the appliance.

Advantageously, the at least two groups of electrodes, in particular clamping elements, of unequal potential contain preferably the same number of clamping elements, each group occupying an essentially annular area on the shell face of the clamping cylinder, and said shell face preferably having one area of positive potential and one area of negative potential when a direct voltage is applied. Reliable contacting of the two unequal potentials on the skin requiring epilation is thereby ensured by simple means.

According to a particular embodiment of the present invention, the electrodes, in particular the clamping elements, of the first group with negative potential are in spaced relation to each other in the circumferential direction of the clamping cylinder in such a way that one clamping element is in contact with the skin practically all the time, thus enabling advantageously a continuous connection between this potential and the skin. By contrast the electrodes, in particular the clamping elements of the second group with positive potential are spaced further apart in the circumferential direction of the clamping cylinder than the electrodes of the first group so that the distance between two consecutive clamping elements in the cylinder's direction of rotation is such that temporarily none of the clamping elements of the second group is in contact with the skin. In spacing the clamping elements of the second group in this manner an advantageous discontinuous contacting of the electrodes with the skin is proposed.

Since the clamping elements are provided preferably as strip-shaped blades diametrically arranged in a rotary cylinder, neighboring clamping elements can be set in an angularly offset relation to each other so that when one clamping element recedes from the skin the neighboring follow-up element is just coming into contact with the skin. This ensures in simple manner that one clamping element is in engagement with the skin at all times. In this arrangement it is well possible for the clamping elements of the second group to be distributed on the rotary cylinder in the same way as the clamping elements of the first group. Considering, however, that only every second clamping element of the second group, for example, is constructed as an electrode, no clamping element of the second group constructed as an electrode is in contact with the skin after the first clamping element is disengaged from the skin and before the third clamping element engages the skin. A construction of the clamping elements as electrodes which enables random options of variation as regards contacting between the electrodes and the skin is thus proposed in simple manner.

In a further aspect of the present invention provision is made for a control device, in particular an electric or electronic circuit, which controls the voltage supply, particularly to the second electrode, should the first and the second electrode be in permanent contact with the skin. Furthermore, the control device reduces the electric current after the second electrode touches the skin. On the one hand a control system permitting a first and a second electrode is thus proposed, wherein both electrodes are in a quasi fixed arrangement on the epilator, i.e., the first electrodes are constructed as clamping elements on a rotary cylinder, their relative distance in the circumferential direction being selected small enough for one clamping element to be in contact with the skin at all times during use. This control device also ensures that only a very small, no longer notable current flows from the electrode into the skin as soon as the positive and the negative pole are in contact with the skin simultaneously.

A particularly advantageous embodiment of the present invention representing an independent solution of the object of the invention proposes a method for the epilation of the human skin, said method involving in particular a step for reducing the sense of pain during the extraction of the hairs by means of an electrically operable epilation appliance with at least one electrode. According to the invention an electric spark is produced on the skin directly prior to the extraction of hairs. The invention uses nerve stimulation produced by the action of a stimulating current, in particular spark discharge, on the skin. This irritation or stimulation of the nerve structures results advantageously in an alleviation of the pain by masking of the pain of epilation while the appliance is being used for epilation.

In an advantageous further configuration of the method, at least one electrode is connected to a voltage source, in particular for electric voltages greater than 0.8 KV, and the electrode is positioned at least temporarily a distance from the skin so that the spark is produced in the air gap between the skin and the electrode.

In a particular embodiment of the method of the present invention, at least two electrodes are connected to a high-voltage source, in particular for voltages of between 0.8 and 3.0 KV but preferably between 1.0 and 2.5 KV. Preferably at least one first electrode is brought, at least temporarily, into contact with the skin requiring epilation and/or at least one second electrode is positioned, at least temporarily, a distance from the skin so that a spark is produced in the air gap between the skin and the first and/or second electrode. Such an implementation of the method results advantageously in itching or tingling on the skin which masks the pain of epilation notably. Particularly suitably, the spark discharge is implemented in such a way that, with an epilation appliance of the previously mentioned type, the spark discharge is controlled in dependence upon the cyclic plucking out of the hairs so that in particular a spark is issued ahead of every plucking operation in time and/or place.

In an advantageous further aspect of the present invention, an electric spark creating an additional pain is produced on the skin prior to the extraction of the hairs with an above mentioned epilation appliance and a method by the means for reducing the sense of pain. This additional pain corresponds in its pain characteristic to the pain of epilation. However, its intensity is preferably lower than the pain of epilation.

Further features, advantages and application possibilities of the present invention will become apparent from the subsequent description of embodiments illustrated in more detail in the accompanying drawing. It will be understood that any single feature and any meaningful combination of single features described and/or represented by illustration form the subject-matter of the present invention, irrespective of their summary in the claims and their back reference.

DETAILED DESCRIPTION OF THE INVENTION

Figure 1:
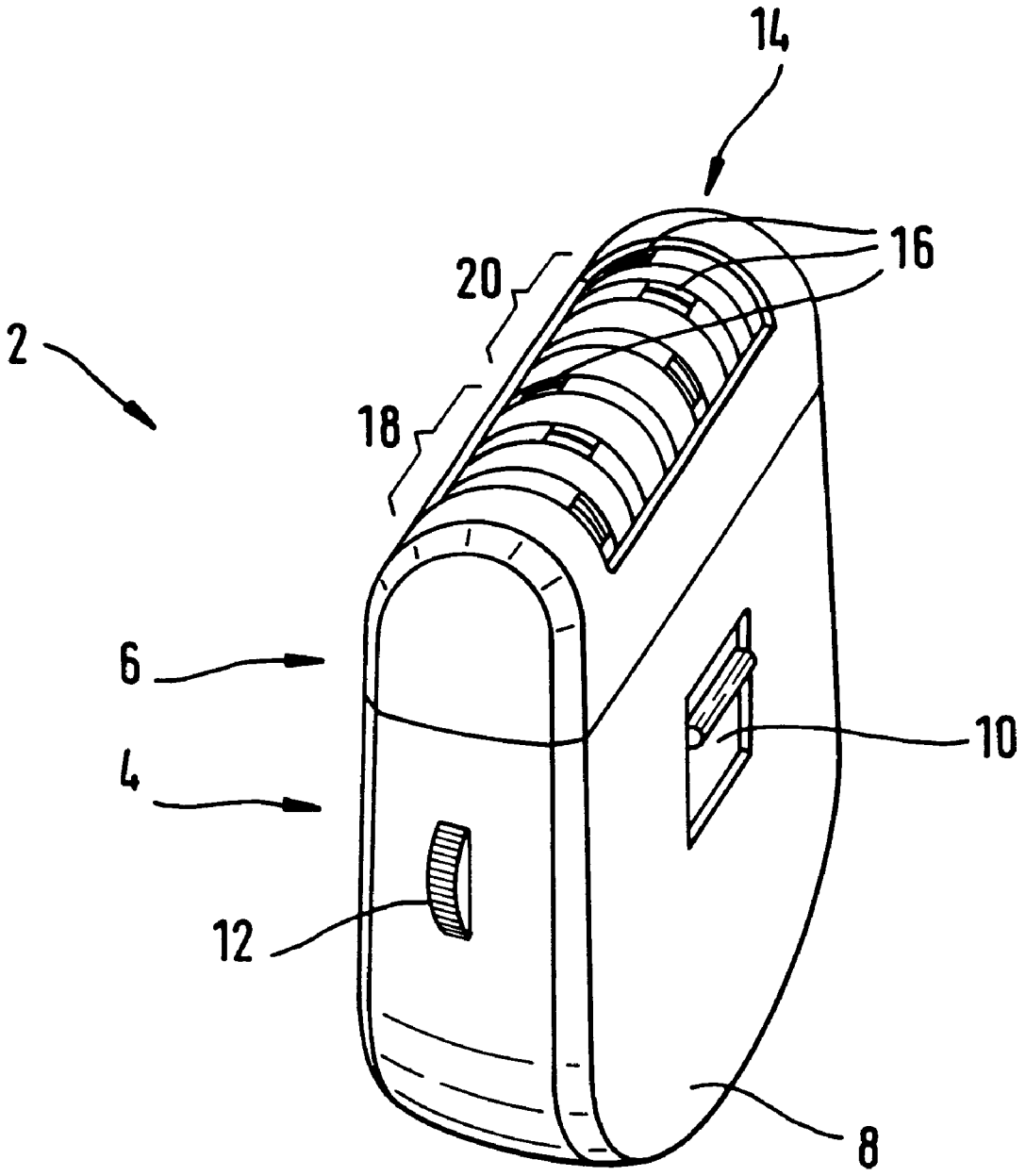
FIG. 1 is a perspective view of an epilation appliance having two groups of first and second electrodes disposed on the rotary cylinder.

An epilation appliance (FIG. 1) in accordance with the present invention is comprised essentially of a grip element 4 and an epilation head 6 mounted on top. Inside the housing 8 is a motor, not showing for the sake of simplicity, and a transmission mechanism for driving the clamping device 14 provided in the epilation head. Inside the housing 8 provision is also made for a high-voltage source, which together with the motor is connectable to a supply voltage, in particular a line voltage or a direct voltage from a primary or secondary battery. The high voltage can be a direct voltage or an alternating voltage, a pulsing or modulated or similar voltage, or it may even consist of pulse bursts.

At the front of the housing 8 is a switch 10 for turning the epilator on and off and for setting an operating level. A separate control 12 is provided for the high-voltage source to be individually set by the user.

The clamping device 14 is a rotary cylinder 14 known in the art and equipped with clamping elements 16 disposed in offset relation to each other. These clamping elements 16 are arranged on the shell face of the rotary cylinder 14 in such a way that there are always two clamping elements 16 in a row and essentially parallel to the axis of rotation of the rotary cylinder. It is also possible, however, for the clamping elements to display any other arrangement on the shell face of the rotary cylinder 14. One group of clamping elements 16 is constructed as first electrodes 18 with positive electric potential, for example, and one group of clamping elements 16 as second electrodes 20 with negative potential, for example, the electrodes being connected to the high-voltage source. This ensures that, when the cylinder 14 is rotated, at least one of the first electrodes 18 can be moved into contact temporarily with the skin requiring epilation and that at least one of the second electrodes 20 is positioned at least temporarily a distance away from the skin requiring epilation so that a spark can be produced in the air gap between the skin and the first and/or second electrode.

In this arrangement it is possible for all the clamping elements of both the first group 18 and the second group 20 to be constructed as electrodes so that a spark can be produced when each individual clamping element 16 approaches the skin requiring epilation. Alternatively it is also possible, however, to construct a different number of clamping elements 16 in the first group 18 than in the second group 20 as electrodes. In this way it is possible to vary the number of spark discharges per revolution of the rotary cylinder 14 as well as the relative spacing, in time and place, of the spark discharges. When a direct voltage is applied as high voltage it is preferred for all the clamping elements 16 of the first group 18 and only every second clamping element 16 of the second group 20 to be connected to the voltage source.

As an alternative to the above described embodiment it is also possible for a grip element 4 (FIG. 2) to be fitted with an epilation head 22 having a clamping device 24 with clamping elements 26. In this alternative, for example, all the clamping elements 26 of the cylinder 24 acting as second electrodes 28 have the same electric potential. The first electrodes 30 and 32 are constructed as sliding contacts and mounted on the top of the housing 34 in such a way as to be in continuous contact with user's skin while the appliance is being used. Hence the electrodes 30 and 32 produce a continuous contact with the skin while the clamping elements 26 revolving with the rotary cylinder 24 produce a temporary contact with the skin. Consequently a spark is produced in the air gap between the skin and the respective electrode 28 prior to the clamping elements 26 approaching the skin requiring epilation. It is also possible for the first electrodes to be arranged at any other position on the outside of the housing and also for them to be constructed as contact pads, for example, and be connected by cable to the high-voltage source.

Figure 2:
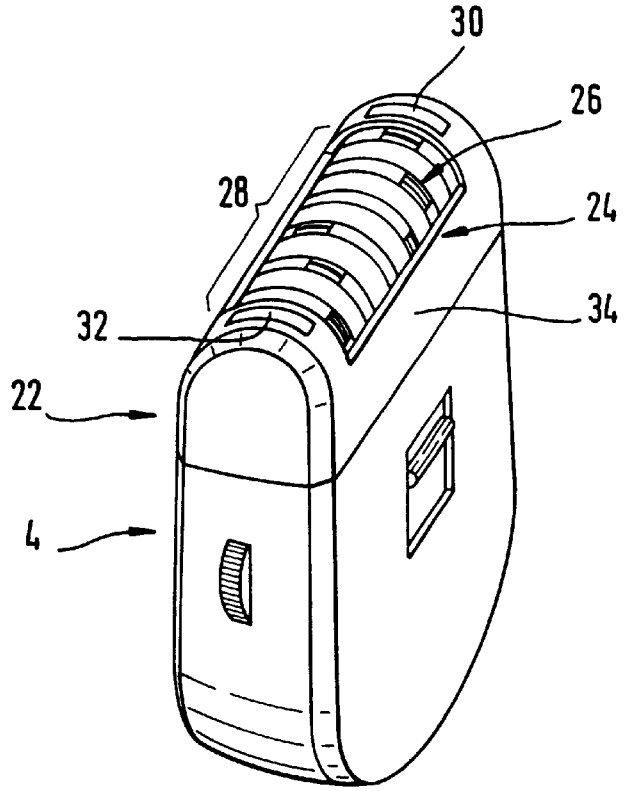
FIG. 2 is a perspective view of an epilation appliance having first electrodes disposed on the outside of the housing and second electrodes on the rotary cylinder.
Figure 3:
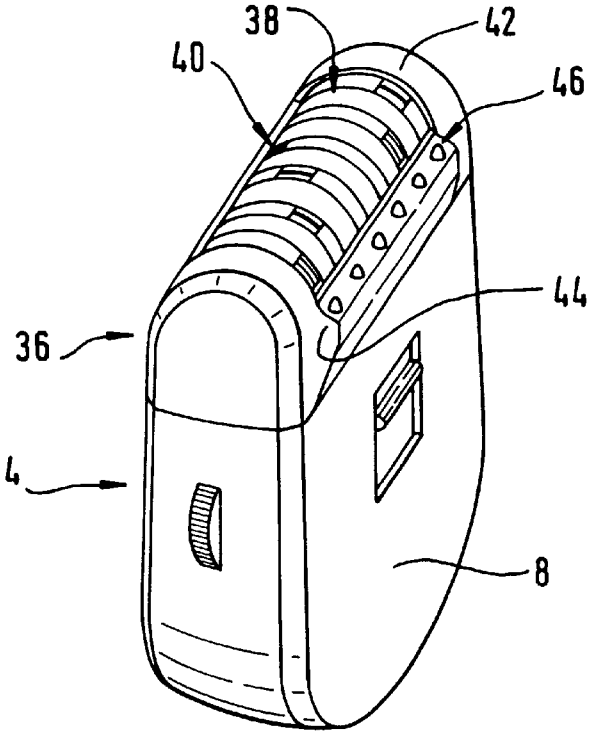
FIG. 3 is a perspective view of an epilation appliance having a group of second electrodes disposed on a separate carrier.

A further embodiment (FIG. 3) makes provision for an epilation head 36 having a rotary cylinder 38 corresponding essentially to the one of FIG. 2. In this embodiment the clamping elements 40 are constructed as a group of first electrodes, and a group of second electrodes 46 is arranged on a separate carrier 44 extending essentially parallel to the longitudinal axis of the rotary cylinder 38 along the outside of the housing. The electrodes 46 are constructed in such a way as to be moved a small distance, preferably around 0.6 mm, above the surface of the skin during use. By contrast, the clamping elements 40 of the rotary cylinder 38 are arranged on the shell face of the cylinder 38 in such a way that one clamping element 40 is always in contact with the skin practically without interruption during use. To produce a spark discharge between the second electrodes 46 and the skin the second electrodes 46 are controlled by a control device, not shown, located inside the housing 8 so that the high voltage is applied to only one of the electrodes 46 at a time.

Figure 4:
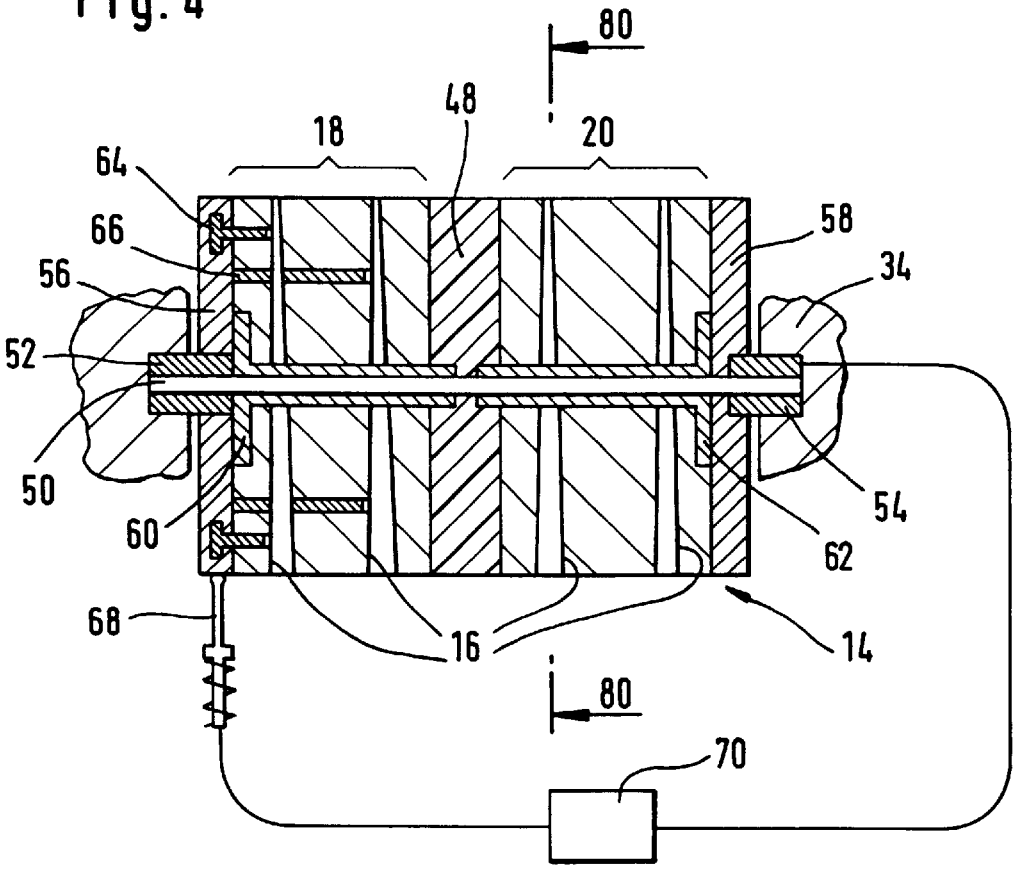
FIG. 4 is a longitudinal sectional view of a rotary cylinder having a group of first and second electrodes.

The rotary cylinder 14 (FIG. 4) is comprised essentially of the clamping elements 16, which are divided into one group of first electrodes 18 and one group of second electrodes 20, the electrodes 18 having a positive potential, for example, and the electrodes 20 a negative potential. Between the two electrode groups 18 and 20 there is an insulator 48 designed to prevent the sparks jumping between the two electrode groups 18 and 20. The rotary cylinder 14 is mounted for rotary movement on a shaft 50 having either end guided by bushings 52 and 54 in the housing 34 of the epilation head. The clamping elements 16, on the other hand, are arranged on sleeves 60 and 62 connected to the shaft 50. At each end of the rotary cylinder 14 provision is made for a contact disk 56 at the one end, and for a disk 58 at the other end, said contact disk 56 being joined to contact pins 64, 66 which in turn are in contact with the clamping elements 16 of the first electrode group 18. The contact disk 56 is also joined to a sliding pin 68 which is connected to a high-voltage source 70 so that an electric potential can be applied to the clamping elements 16 of the first electrode group 18 via the sliding pin 68, the contact disk 56 and the contact pins 64 and 66.

The second pole of the high-voltage source 70 is connected to the clamping elements 16 of the second electrode group 20 via the bushing 54, the shaft 50 and the sleeve 62. These electrically conductive parts are made of an electrically conductive material, preferably brass, nickel, copper, carbon or a ferriferous material or are provided with an electrically conductive coating.

The bushing 52, the sleeve 60 and the disk-shaped insulator 48 are made of an electrically insulating material so that spark discharge between the electrodes of the first group 18 and those of the second group 20 is prevented.

Figure 5:
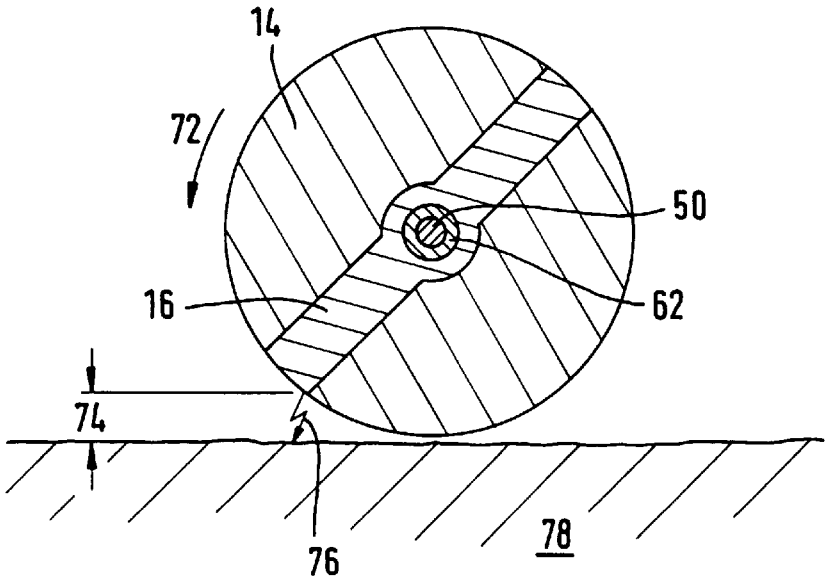
FIG. 5 is a sectional view of a rotary cylinder taken along the line 80—80 of FIG. 4.

The rotary cylinder 14 (FIG. 5) is penetrated essentially diametrically by a strip-shaped clamping element 16 and mounted for rotary movement on the shaft 50 by means of the sleeve 62. When the epilator is used, the rotary cylinder 14 is moved in the direction of rotation 72 over the surface of the skin 78 requiring epilation. As this occurs, the clamping element 16 approaches the skin 78 so that, upon reaching a distance 74, a spark 76 is produced between the clamping element 16, constructed as an electrode, and the skin 78. The spark 76 will then jump over when the dielectric strength of the air is overcome, i.e., when the voltage-carrying clamping element 16 has approached the skin to the required distance 74. The air gap between the skin requiring epilation and the electrode—at a discharge voltage of up to 5 KV—equals a distance of up to around 1 millimeter; in particular spark discharge begins at an air gap of 0.6 mm, approximately.

In a preferred embodiment the electric voltage is set from 1.0 to 2.5 KV, approximately. This voltage discharges as an inversely proportional function of the distance 74, meaning that an initial spark discharge can be produced at a distance 74 of 0.6 mm, approximately, and that a spark discharge with a frequency of 2.5 kHz, approximately, takes place at a distance of 0 mm, approximately, i.e. when the electrically conductive clamping element 16 is in contact with the skin.

What is claimed is:

1. An epilation appliance for epilation of the human skin, said appliance comprising:

a clamping device a motor for driving the clamping device;

a hand-holdable housing which accommodates the motor wherein the clamping device includes clamping elements to grip and pluck hairs, and with a means for reducing the sense of pain during the extraction of hairs, said means comprising at least one spark-producing electrode operable to produce an electric spark prior to extracting the hairs.

2. The epilation appliance as claimed in claim 1, wherein said means is equipped with a voltage source, and wherein said at least one spark-producing electrode is connectable to said voltage source, and said means causes said at least one spark-producing electrode to be at least temporarily a distance away from the skin, thus enabling the spark to be produced in an air gap between the skin and the at least one electrode.

3. The epilation appliance as claimed in claim 1, wherein said means comprises at least two electrodes including a first electrode and a second, spark-producing electrode and a high-voltage source, and said at least two electrodes are connectable to the high-voltage source, and said first electrode is movable at least temporarily into contact with the skin while said second, spark-producing electrode is at least temporarily a distance away from the skin, thus enabling the spark to be produced in the air gap between the skin and the second, spark-producing electrode.

4. The epilation appliance as claimed in claim 2, wherein said at least one spark-producing electrode is connected to the clamping device and is constructed as one of a clamping element brush, a contact ring, and a contact disk.

5. The epilation appliance as claimed in claim 4, wherein the clamping device is constructed as a rotary cylinder having an axis of rotation and said means includes a separate contact pin for connecting to the voltage source and extending essentially parallel to the axis of rotation of the clamping device is allocated to the at least one spark-producing electrode.

6. The epilation appliance as claimed in claim 5, wherein said means includes two spark-producing electrodes which also function as some of the clamping elements and which are arranged side by side on the rotary cylinder in a row.

7. The epilation appliance as claimed in claim 5, wherein the contact pin is adapted to make contact at one end with said at least one spark-producing electrode.

8. The epilation appliance as claimed in claim 2, wherein the clamping device is constructed as a rotary cylinder and includes bushings mounted in the housing and an electrically conductive shaft that is carried in said bushings, and wherein said at least one spark-producing electrode is joinable to the shaft by an electrically conductive connection.

9. The epilation appliance as claimed in claim 1, wherein said means comprises a plurality of electrodes among which there is at least one group of electrodes of equal electric potential.

10. The epilation appliance as claimed in claim 9, wherein said clamping device includes a clamping cylinder having a shell face and said means comprises a plurality of electrodes among which there is at least two groups of electrodes of unequal potential contact, each group occupying an essentially annular area on the shell face of the clamping cylinder, and said shell face having one area of positive potential and one area of negative potential when a direct voltage is applied.

11. The epilation appliance as claimed in claim 10, wherein the electrodes of a first group have negative potential and are in spaced relation to each other in a circumferential direction of the clamping cylinder in such a way that one electrode of the first group is in contact with the skin practically all the time, and the electrodes of the second group have a positive potential and are in spaced relation to each other in the circumferential direction of the clamping cylinder in such manner that the distance formed between two consecutive electrodes in a direction of rotation of the cylinder is such that temporarily none of the electrodes of the second group is in contact with the skin.

12. The epilation appliance as claimed in claim 3, further comprising a control circuit, which controls voltage to the second, spark-producing electrode, should said second, spark-producing electrode be in permanent contact with the skin, and which reduces electric current after the second, spark-producing electrode touches the skin.

13. The epilation appliance as claimed in claim 2, wherein said voltage source produces electric voltages greater than 0.8 KV.

14. The epilation appliance as claimed in claim 3, wherein said high-voltage source produces voltages of between 0.8 and 3.0 KV.

15. The epilation appliance as claimed in claim 2, wherein said at least one spark-producing electrode is connected to the clamping device and constructed as one of a contact shoe, contact bridge, sliding contact, suction contact, contact pad and contact plate and is arranged on the outside of the housing.

16. The epilation appliance as claimed in claim 5, wherein said means includes a plurality of electrodes at least some of which also function as some of the clamping elements and which are arranged in neighboring rows on the rotary cylinder, with the clamping elements of one row being arranged at an angular offset to the clamping elements of a neighboring row.

17. The epilation appliance as claimed in claim 5, wherein said means includes a sliding ring connectable to the voltage source and wherein the contact pin is adapted to make contact at one end with said at least one spark-producing electrode and at another end with the sliding ring.

18. The epilation appliance as claimed in claim 2, wherein the clamping device is constructed as a rotary cylinder and includes bushings mounted in the housing and an electrically conductive shaft that is carried in said bushings, and wherein said at least one spark-producing electrode is joinable to the shaft by an electrically conductive connection and at least one of said bushings is joinable to the voltage source.

19. The epilation appliance as claimed in claim 1, wherein said means comprises a plurality of electrodes among which there are at least two groups of electrodes of unequal electric potential, wherein between the two groups of electrodes of unequal potential an electric insulator is provided.

20. A method for the epilation of the human skin, comprising:

producing an electric spark on the skin near where hairs are located; and immediately thereafter, extracting the hairs from the skin.

21. The method as claimed in claim 20, wherein producing a spark comprises connecting at least one electrode to a voltage source, and positioning said at least one electrode at least temporarily a distance from the skin so that the spark is produced in an air gap that is formed between the skin and the at least one electrode.

22. The method as claimed in claim 20 or 21, wherein producing a spark comprises connecting at least two electrodes to the voltage source, and bringing at least one of said at least two electrodes is, at least temporarily, into contact with the skin.

23. The method as claimed in claim 20, wherein said spark provokes an additional pain corresponding in its pain characteristic to the pain of epilation, but having a lower pain intensity.

* * * * *